US006436896B2

(12) United States Patent
Charlton et al.

(10) Patent No.: US 6,436,896 B2
(45) Date of Patent: Aug. 20, 2002

(54) METHOD FOR PREPARING FABRIC SOFTENING COMPOSITIONS

(75) Inventors: Ian David Charlton; David Stephen Grainger; Mansur Sultan Mohammadi; Prabhat Sakya, all of Bebington (GB)

(73) Assignee: Unilever Home & Personal Care USA, a divison of Conopco, Inc., Greenwich, CT (US)

( * ) Notice: Subject to any disclaimer, the term of this patent is extended or adjusted under 35 U.S.C. 154(b) by 0 days.

(21) Appl. No.: 09/741,379

(22) Filed: Dec. 20, 2000

(30) Foreign Application Priority Data

Dec. 22, 1999 (GB) ..... 9930430

(51) Int. Cl.[7] ..... C11D 1/835
(52) U.S. Cl. ..... 510/527; 510/522
(58) Field of Search ..... 510/516, 515, 510/524, 527, 522

(56) References Cited

U.S. PATENT DOCUMENTS 4,800,038 A * 1/1989 Broze et al. ..... 252/174.17

FOREIGN PATENT DOCUMENTS

| | | | |
|---|---|---|---|
| EP | 380406 A2 | * | 8/1990 |
| WO | WO 96/15213 | * | 5/1996 |
| WO | WO 98/16538 | * | 4/1998 |

* cited by examiner

*Primary Examiner*—John Hardee
(74) *Attorney, Agent, or Firm*—Ellen Plotkin

(57) ABSTRACT

The invention provides a method for the preparation of an aqueous fabric softening composition comprising;

(i) at least one cationic fabric softening compound having two or more alkyl or alkenyl chains each having an average chain length equal to, or greater than, $C_8$ and (ii) at least one oily sugar derivative, wherein the cationic fabric softening compound (i), and/or the oily sugar derivative (ii) is/are separately mixed with another active component of the fabric softening composition to form a pre-mixture prior to the admixing of the softening compound (i) with the oily sugar derivative (ii).

The invention also provides an aqueous based fabric softening composition produced by the method of the invention, and, a method of treating fabrics with the composition so produced.

8 Claims, No Drawings

METHOD FOR PREPARING FABRIC SOFTENING COMPOSITIONS

TECHNICAL FIELD

The present invention relates to a method for the preparation of aqueous fabric softening compositions, in particular, to the preparation of compositions comprising at least one cationic fabric softening compound and at least one oily sugar derivative. The invention also relates to the compositions produced by the method and to a method of treating clothes with the compositions.

BACKGROUND AND PRIOR ART

Rinse-added fabric softener compositions are well known in the art. However, a disadvantage associated with conventional rinse conditioners is that although they increase the softness of a fabric they often simultaneously decrease its absorbency so that the ability of the fabric to take up water decreases. This is particularly disadvantageous with towels where the consumer requires the towel to be soft, and yet, have a high absorbency.

To overcome this problem it has been proposed to use fabric softening compositions comprising an oily sugar derivative as a softening compound as it has been found that these provide good softening without decreasing the absorbency of the treated fabric. WO 98/16538 (Unilever) discloses fabric softening compositions comprising liquid or soft solid derivatives of a cyclic polyol or a reduced saccharide which give good softening and retain absorbency of the fabric.

Our co-pending UK patent application GB 9911437.3 discloses fabric softening compositions comprising liquid or soft solid derivatives of a cyclic polyol or a reduced saccharide, at least one anionic surfactant, and at least one cationic polymer.

Our co-pending UK patent application GB 9911434.0 discloses fabric softening compositions comprising liquid or soft solid derivatives of a cyclic polyol or a reduced saccharide, the derivatives having at least one unsaturated bond in the alkyl or alkenyl chains present, with the compositions further comprising a deposition aid and one or more antioxidants.

EP 0 380 406 (Colgate-Palmolive) discloses detergent compositions comprising a saccharide or reduced saccharide ester containing at least one fatty acid chain.

WO 95/00614 (Kao Corporation) discloses softening compositions comprising polyhydric alcohol esters and cationised cellulose. U.S. Pat. No. 5,447,643 (Hüls) discloses aqueous fabric softeners comprising nonionic surfactant and mono, di or tri fatty acid esters of certain polyols.

WO 96/15213 (Henkel) discloses textile softening agents containing alkyl, alkenyl and/or acyl group containing sugar derivatives, which are solid after esterification, in combination with nonionic and cationic emulsifiers.

It is sometimes desirable to use the aforementioned oily sugar derivatives in a blend with conventional cationic fabric softening compounds, such as quaternary ammonium fabric softening compounds, to provide a range of benefits including improved creaming stability of concentrated compositions, and improved re-wettability of fabrics.

However it has been found that the conventional method of preparing fabric softening compositions comprising more than one fabric softening compound wherein the softening compounds are co-melted together (which may subsequently be used to form a dispersion in water), has certain disadvantages for preparing compositions comprising oily sugar derivative(s) and cationic fabric softening compound (s).

For example, the compositions so produced often exhibit poor stability upon storage (ie they have a tendency to 'cream' and separate which is referred to herein as stability or creaming stability and/or are unacceptable to the consumer having a non-homogenous, lumpy, appearance. It is also been found that these compositions suffer from reduced softening performance, possibly due to the non-homogeneity of the compositions.

The present invention is directed towards alleviating the above problems, and in particular to providing a method of preparing fabric softening compositions comprising at least one oily sugar derivative and at least one cationic fabric softening compound, wherein, the compositions produced exhibit improved creaming stability compared to the compositions prepared by conventional methods, and/or are of a substantially homogenous appearance.

It has been found that by preparing fabric conditioning compositions comprising at least one oily sugar derivative (ii) and at least one conventional cationic fabric softening compound (i) by pre-mixing the softening compound (ii) and/or the oily sugar derivative (ii) with another active component of the composition prior to admixing the softening compound (i) with the oily sugar derivative (ii) that the above problems can be overcome, and, certain advantages are provided.

The principal advantages of the present invention include that the compositions produced have an acceptable appearance to the consumer and that they exhibit good creaming stability upon storage.

DEFINITION OF THE INVENTION

Thus according to one aspect of the invention there is provided a method for the preparation of an aqueous fabric softening composition comprising;

(i) at least one cationic fabric softening compound having two or more alkyl or alkenyl chains each having an average chain length equal to, or greater than, $C_8$ and (ii) at least one oily sugar derivative, wherein the cationic fabric softening compound (i), and/or the oily sugar derivative (ii) is/are separately mixed with another active component of the fabric softening composition to form a pre-mixture prior to the admixing of the softening compound (i) with the oily sugar derivative (ii).

It has been found, surprisingly, that the above method provides an unexpected improvement in the stability, and in the homogeneity of their appearance, of the compositions produced.

According to a further aspect the present invention provides an aqueous based fabric softening composition produced by the method of the invention and a method of treating fabric by applying thereto said composition.

DETAILED DESCRIPTION OF THE INVENTION

The present invention provides a method of preparing an aqueous fabric softening composition comprising at least one cationic fabric softening compound having two or more alkyl or alkenyl chains each having an average chain length equal to, or greater than, $C_8$ and at least one oily sugar derivative.

The method has, as an essential step, the step of either the cationic fabric softening compound or the oily sugar derivative being separately mixed with another active component of the fabric softening composition to form a pre-mixture prior to the admixing of the softening compound with the oily sugar derivative to produce the fabric softening composition. This step of pre-mixing with another active component of the composition to form a pre-mixture prior to said admixing may also apply to both the cationic fabric softening compound and the oily sugar derivative.

The term "active component" as used herein defines a component of the compositions which has a functional role therein and which is supplied as a separate raw material product. Active component includes nonionic and cationic surfactants and perfumes but with the proviso that it is not an anionic surfactant. The term also does not include water, dyes, preservatives or any of the minor optional ingredients recited in the paragraph immediately under the heading "Minor ingredients".

However, the term does not include where a component raw material is supplied with a minor amount of an "active component" included as part of that raw material as obtained from the manufacturer. Thus, for example, a cationic fabric softening compound raw material (supplied as comprising a minor amount of a surfactant) mixed directly with an oily sugar derivative raw material in the absence of another "active component" raw material as defined above would not form part of the invention.

The separate pre-mixing of the cationic fabric softening compound and/or the oily sugar derivative with another active component of the fabric softening composition to form said pre-mixture may occur in any known manner.

In all embodiments of the invention either the cationic fabric softening compound or the oily sugar derivative must be pre-mixed with an active component. Preferably both said compound and said derivative are pre-mixed with an active component. The following description of the invention is to be read in this context. As long as one of said compound or derivative is mixed with the active component then the derivative or compound (as appropriate) can be pre-mixed with water and/or composition active ingredients, as described, or it can be added without being pre-mixed.

Accordingly the method of the invention does not encompass pre-mixing the cationic fabric softening compound with water and separately the oily sugar derivative with water, in the absence of an active component, and mixing these two mixtures. It also does not encompass co-melting said softening compound and said derivative together in the presence of an active component.

The method may incorporate one or more of the following ways of forming the pre-mixture for the cationic fabric softening compound or the oily sugar derivative.

According to one preferred method the oily sugar derivative (ii) is pre-mixed with at least one cationic and/or nonionic surfactant having a single $C_8$–$C_{28}$ alkyl or alkenyl chain and optionally water, to form a pre-mixture and subsequently the softening compound (i), in at least partially liquid or molten state, is mixed with said pre-mixture.

For this method the pre-mixture formed from the oily sugar derivative (ii) is preferably at a temperature of at least 30° C., preferably at least 40° C., most preferably at least 50° C., when the softening compound (i) is mixed therewith. However the resultant mixture from the pre-mixture and the softening compound being mixed together may subsequently be heated to a temperature of at least 30° C., preferably at least 40° C., most preferably at least 50° C.

According to another preferred method the softening compound (i) is pre-mixed with at least one cationic and/or nonionic surfactant, both having a single $C_8$–$C_{28}$ alkyl or alkenyl chain and optionally water, to form a pre-mixture and subsequently the oily sugar derivative (ii) is mixed with said pre-mixture.

For this method it is especially preferred that the cationic fabric softening compound (i) is pre-mixed with at least one nonionic surfactant (as defined above) and optionally water.

Without wishing to be bound by theory it is believed that the invention prevents 'complexation' droplet structures forming between the cationic fabric softening compound(s) and the oily sugar derivative(s) in turn leading to a decreased tendency for 'creaming' instability and/or lumps to form.

It is believed that co-packing of any mono, di and tri esters of the oily sugar derivative(s) with the cationic softener is avoided by this method. The aforementioned mono, di and tri esters of the oily sugar derivative(s) are thought to be less compatible with the cationic softener than are the higher esters.

This co-packing alters/lowers the HLB of the surfactant mixture making it more likely to form a water-in-oil emulsion rather than oil-in-water emulsion. As a result, both emulsion are produced and it is believed this promotes the formation of 'complexation' droplet structures. By using the method of the invention we reduce the co-packing possibility and avoid the formation of said droplets.

Ingredients (i) The Cationic Fabric Softening Compound

The compositions comprise at least one cationic fabric softening compound having two or more alkyl or alkenyl chains each having an average chain length equal to, or greater, than $C_8$.

Quaternary ammonium fabric softening compounds are typically used as the cationic fabric softening compound. It is advantageous for environmental reasons if the quaternary ammonium material is biologically degradable.

Preferably the cationic fabric softening compound is a quaternary ammonium compound having two or more, eg three, $C_{12-28}$ alkyl or alkenyl chains, most preferably connected to a nitrogen atom via at least one ester link. Quaternary ammonium compounds having two or three $C_{12-28}$ alkyl or alkenyl chains connected to a nitrogen atom via at least one ester link are especially preferred.

Especially suitable compounds have two or more alkyl or alkenyl chains each having an average chain length equal to, or greater than $C_{14}$ more preferably, equal to or greater $C_{16}$. Most preferably at least 50% of the total number of alkyl or alkenyl chains have a chain length equal to, or greater than $C_{18}$.

It is preferred if the alkyl or alkenyl chains of the cationic fabric softening compound are predominantly linear.

In particular, quaternary ammonium fabric softening compounds comprising a polar head group and two or three alkyl or alkenyl chains each having an average chain length equal to or greater than $C_{14}$ may be used.

The cationic fabric softening compounds used in the compositions are molecules which provide good softening. Some types, especially those of type (II), are preferably characterised by a chain melting $L\beta$ to $L\alpha$ transition temperature greater than 25° C., preferably greater than 35° C., most preferably greater than 45° C. This $L\beta$ to $L\alpha$ transition can be measured by DSC as defined in "Handbook of Lipid Bilayers", D Marsh, CRC Press, Boca Raton Fla., 1990 (Pages 137 and 337).

A first preferred type of ester-linked quaternary ammonium material for use as the cationic fabric softening compound is represented by the formula (I):

(I)

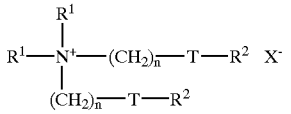

wherein each $R^1$ group is independently selected from $C_{1-4}$, alkyl or hydroxyalkyl or $C_{2-4}$ alkenyl groups; and wherein each $R^2$ group is independently selected from $C_{8-28}$ alkyl or alkenyl groups;

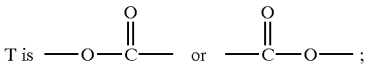

$X^-$ is any suitable anion including a halide, acetate or lower alkosulphate ion, such as chloride or methosulphate, and n is O or an integer from 1–5.

Di(tallowoyloxyethyl) dimethyl ammonium chloride and methyl bis-[ethyl (tallowoyl)]-2-hydroxyethyl ammonium methyl sulphate are especially preferred. The tallow chains in these compounds may be hardened and may even be fully unsaturated, i.e. preferred compounds also include di(hardened tallowoyloxy ethyl) dimethyl ammonium chloride and methyl bis-[ethyl(hardened tallowoyl)]-2-hydroxyethyl ammonium methyl sulphate.

Commercially available compounds include those in the Tetranyl range (ex Kao) and Stepantex range (ex Stepan).

A second preferred type of ester-linked quaternary ammonium material for use as the cationic fabric softening compound is represented by formula (II):

(II)

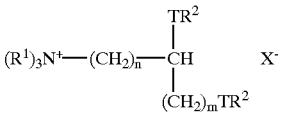

wherein $R^1$, $R^2$, n, T and $X^-$ are as defined above, and m is from 1 to 5.

Preferred materials of this class such as 1,2 bis[hardened tallowoyloxy]-3-trimethylammonium propane chloride and their method of preparation are, for example, described in U.S. Pat. No. 4,137,180 (Lever Brothers). Preferably these materials comprise small amounts of the corresponding monoester as described in U.S. Pat. No. 4,137,180 for example 1-hardened tallowoyloxy-2-hydroxy 3-trimethylammonium propane chloride.

A third preferred type of ester-linked quaternary ammonium material for use as the cationic fabric softening compound is represented by formula (III):

Formula (III)

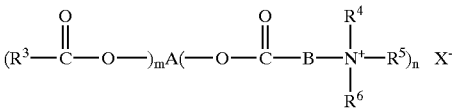

wherein $X^-$ is as defined above, A is an (m+n) valent radical remaining after the removal of (m+n) hydroxy groups from an aliphatic polyol having p hydroxy groups and an atomic ratio of carbon to oxygen in the range of 1.0 to 3.0 and up to 2 groups per hydroxy group selected from ethylene oxide and propylene oxide, m is 0 or an integer from 1 to p−n, n is an integer from 1 to p−m, and p is an integer of at least 2, B is an alkylene or alkylidene group containing 1 to 4 carbon atoms, $R^3$, $R^4$, $R^5$ and $R^6$ are, independently from each other, straight or branched chain $C_1$–$C_{48}$ alkyl or alkenyl groups, optionally with substitution by one or more functional groups and/or interruption by at most 10 ethylene oxide and/or propylene oxide groups, or by at most two functional groups selected from

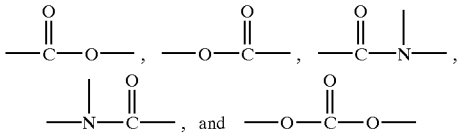

or $R^4$ and $R^5$ may form a ring system containing 5 or 6 atoms in the ring, with the proviso that the average compound either has at least one R group having 22–48 carbon atoms, or at least two R groups having 16–20 carbon atoms, or at least three R groups having 10–14 carbon atoms. Preferred compounds of this type are described in EP 638 639 (Akzo).

A preferred class of quaternary ammonium cationic fabric softening agent that do not contain an ester linking group is defined by formula (IV):

(IV)

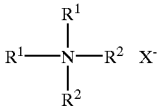

wherein each $R^1$ group is independently selected from $C_{1-4}$ alkyl, hydroxyalkyl or $C_{2-4}$ alkenyl groups; $R^2$ group is independently selected from $C_{8-28}$ alkyl or alkenyl groups, and $X^-$ is as defined above.

A preferred of formula (IV) is di-hardened tallow-dimethyl ammonium chloride, sold under the Trademark ARQUAD 2HT by Akzo Nobel.

The compositions preferably comprise between 0.5% wt–30% wt of the softening compound (i), preferably 1%–25%, more preferably 1.5–23%, most preferably 2%–21%, based on the total weight of the composition.

(ii) Oily Sugar Derivative

The compositions comprise at least one oily sugar derivative.

The oily sugar derivative used in the compositions is preferably a liquid or soft solid derivative of a cyclic polyol or of a reduced saccharide, said derivative resulting from 35 to 100% of the hydroxyl groups in said polyol or in said saccharide being esterified or etherified. The derivative has two or more ester or ether groups independently attached to a $C_8$–$C_{22}$ alkyl or alkenyl chain.

The oily sugar derivative is also referred to herein as derivative-CP and derivative-RS dependant upon whether the derivative is derived from a cyclic polyol or from a reduced saccharide starting material respectively.

Preferably 35 to 85% most preferably 40 to 80%, even more preferably 45 to 75%, such as 45 to 70% of the hydroxyl groups in said cyclic polyol or in said reduced saccharide are esterified or etherified to produce the derivative-CP or derivative-RS respectively.

Preferably the derivative-CP or derivative-RS contains 35% tri or higher esters, eg at least 40%.

The derivative-CP and derivative-RS used do not have any substantial crystalline character at 20° C. Instead it is preferably in a liquid or soft solid state, as hereinbelow defined, at 20° C.

The starting cyclic polyol or reduced saccharide material is esterified or etherified with $C_8$–$C_{22}$ alkyl or alkenyl chains to the appropriate extent of esterication or etherification so that the derivatives are in the requisite liquid or soft solid state. These chains may contain unsaturation, branching or mixed chain lengths.

For the derivative-CP and derivative-RS the tetra, penta etc prefixes only indicate the average degrees of esterification or etherification. The compounds exist as a mixture of materials ranging from the monoester to the fully esterified ester. It is the average degree of esterification as determined by weight which is referred to herein.

Typically the derivative-CP and derivative-RS has 3 or more, preferably 4 or more, for example 3 to 8, eg 3 to 5, ester or ether groups or mixtures thereof. It is preferred if two or more of the ester or ether groups of the derivative-CP or derivative-RS are independently of one another attached to a $C_8$ to $C_{22}$ alkyl or alkenyl chain. The alkyl or alkenyl groups may be branched or linear carbon chains.

Derivative-CPs are preferred for use in the compositions. Inositol is a preferred cyclic polyol, and Inositol derivatives are especially preferred.

In the context of the present invention the terms derivative-CP and derivative-RS encompass all ether or ester derivatives of all forms of saccharides, which are especially preferred for use in the compositions. Examples of preferred saccharides for the derivative-CP and derivative-RS to be derived from are monosaccharides and disaccharides.

Examples of monosaccharides include xylose, arabinose, galactose, fructose, sorbose and glucose. Glucose is especially preferred. An example of a reduced saccharide is sorbitan. Examples of disaccharides include maltose, lactose, cellobiose and sucrose. Sucrose is especially preferred.

If the derivative-CP is based on a disaccharide it is preferred if the disaccharide has 3 or more ester or ether groups attached to it. Examples include sucrose tri, tetra and penta esters.

Where the cyclic polyol is a reducing sugar it is advantageous if each ring of the derivative-CP has one ether group, preferably at the $C_1$ position. Suitable examples of such compounds include methyl glucose derivatives.

Examples of suitable derivative-CPs include esters of alkyl(poly)glucosides, in particular alkyl glucoside esters having a degree of polymerisation from 1 to 2.

The HLB of the derivative-CP and derivative-RS is typically between 1 and 3.

The derivative-CPs and derivative-RSs may have branched alkyl or alkenyl chains (of varying degrees of branching), mixed chain lengths and/or unsaturation. Those having unsaturated and/or mixed alkyl chain lengths are particularly preferred.

One or more of the alkyl or alkenyl chains (independently attached to the ester or ether groups) may contain at least one unsaturated bond.

For example, predominantly unsaturated fatty chains may be attached to the ester/ether groups, e.g. those attached may be derived from rape oil, cotton seed oil, soybean oil, oleic, tallow, palmitoleic, linoleic, erucic or other sources of unsaturated vegetable fatty acids.

The alkyl or alkenyl chains of the derivative-CP and derivative-RS are preferably predominantly unsaturated, for example sucrose tetratallowate, sucrose tetrarapeate, sucrose tetraoleate, sucrose tetraesters of soybean oil or cotton seed oil, cellobiose tetraoleate, sucrose trioleate, sucrose triapeate, sucrose pentaoleate, sucrose pentarapeate, sucrose hexaoleate, sucrose hexarapeate, sucrose triesters, pentaesters and hexaesters of soybean oil or cotton seed oil, glucose trioleate, glucose tetraoleate, xylose trioleate, or sucrose tetra-,tri-, penta-or hexaesters with any mixture of predominantly unsaturated fatty acid chains.

However some derivative-CPs and derivative-RSs based on polyunsaturated fatty acid derived alkyl or alkenyl chains, eg sucrose tetralinoleate, may be used if most of the polyunsaturation has been removed by partial hydrogenation.

The most highly preferred liquid derivative-CPs and derivative-RSs are any of those mentioned in the above three paragraphs but where the polyunsaturation has been removed through partial hydrogenation.

Especially good results are obtained when the alkyl and/or alkenyl chains of the derivative-CPs and derivative-RSs are obtained by using a fatty acid mixture (to react with the starting cyclic polyol or reduced saccharide) which comprises a mixture of tallow fatty acid and oleyl fatty acid in a weight ratio of 10:90 to 90:10, more preferably 25:75 to 75:25, most preferably 30:70 to 70:30. A fatty acid mixture comprising a mixture of tallow fatty acid and oleyl fatty acid in a weight ratio of 60:40 to 40:60 is most preferred.

Especially preferred are fatty acid mixtures comprising a weight ratio of approximately 50wt % tallow chains and 50wt % oleyl chains. It is especially preferred that the fatty acid mixture consists only of a mixture of tallow fatty acid and oleyl fatty acid.

Preferably 40% or more of the chains contain an unsaturated bond, more preferably 50% or more, most preferably 60% or more e.g. 65% to 95%.

Oily sugar derivatives suitable for use in the compositions include sucrose pentalaurate, sucrose tetraoleate, sucrose pentaerucate, sucrose tetraerucate, and sucrose pentaoleate.

Suitable materials include some of the Ryoto series available from Mitsubishi Kagaku Foods Corporation.

The liquid or soft solid derivative-CPs and derivative-RSs are characterised as materials having a solid:liquid ratio of between 50:50 and 0:100 at 20° C. as determined by $T_2$ relaxation time NMR, preferably between 43:57 and 0:100, most preferably between 40:60 and 0:100, such as, 20:80 and 0:100. The $T_2$ NMR relaxation time is commonly used for characterising solid:liquid ratios in soft solid products such as fats and margarines. For the purpose of the present invention, any component of the NMR signal with a $T_2$ of less than 100 microsecond is considered to be a solid component and any component with $T_2$ greater than 100 microseconds is considered to be a liquid component.

The liquid or soft solid derivative-CPs and derivative-RSs can be prepared by a variety of methods well known to those skilled in the art. These methods include acylation of the starting cyclic polyol or reduced saccharide material with an acid chloride; trans-esterification of the starting cyclic polyol or reduced saccharide material with fatty acid esters using a variety of catalysts; acylation of the starting cyclic polyol or reduced saccharide material with an acid anhydride and acylation of the starting cyclic polyol or reduced saccharide material with a fatty acid. Typical preparations of these materials are disclosed in U.S. Pat. No. 4,386,213 and AU 14416/88 (Procter and Gamble).

The composition preferably comprises between 0.5%–50% wt of the oily sugar derivative (ii), more preferably 1–25% wt, most preferably 2–20% wt, e.g. 3–15% wt %, based on the total weight of the composition.

The weight ratio of the cationic fabric softening compound (i): oily sugar derivative (ii) is preferably in the range 99:1 to 1:10, preferably 10:1 to 1:5, more preferably 5:1 to 1:1, e.g. 4:1 to 1:1. The cationic fabric softening compound (i) is preferably present in the composition in an amount of 50%–99% by weight, preferably 55%–85%, more preferably 60%–80% based on the total weight of the softening compound (i) and oily sugar derivative (ii).

If the oily sugar derivative or quaternary ammonium softening compound comprises hydrocarbyl chains formed from fatty acids or fatty acyl compounds which are unsaturated or at least partially unsaturated (e.g. having an iodine value of from 5 to 140, preferably 5 to 100, more preferably 5 to 60, most preferably 5 to 40, e.g. 5 to 25), then the cis:trans isomer weight ratio in the fatty acid/fatty acyl compound is greater than 20/80, preferably greater than 30/70, more preferably greater than 40/60, most preferably greater than 50/50, e.g. 70/30 or greater. It is believed that higher cis:trans isomer weight ratios afford the compositions comprising the compound better low temperature stability and minimal odour formation. Suitable fatty acids include Radiacid 406, ex Fina.

Saturated and unsaturated fatty acids/acyl compounds may be mixed together in varying amounts to provide a compound having the desired iodine value.

Fatty acids/acyl compounds may also be, at least partially hydrogenated to achieve lower iodine values.

Of course, the cis:trans isomer weight ratios can be controlled during hydrogenation by methods known in the art such as by optimal mixing, using specific catalysts and providing high $H_2$ availability.

Water

The compositions are aqueous compositions and preferably contain water in an amount of at least 50% by weight, more preferably at least 60%, for example at least 70%, based on the total weight of the composition. All, or a part, of the water to be included in the composition may be used to form the pre-mixture for the cationic fabric softening compound (i) and/or for the pre-mixture for the oily sugar derivative (ii).

Active Components

The active component used to form the pre-mixture with the cationic fabric softening compound (i), and/or the oily sugar derivative (ii) prior to the admixing of said softener and said derivative is preferably selected from one or more of a nonionic surfactant, a cationic surfactant and/or a perfume.

Cationic Surfactant

The cationic fabric softening compound (i) and/or the oily sugar derivative (ii) may separately be mixed with at least one cationic surfactant and optionally water having a single $C_8$–$C_{28}$ alkyl or alkenyl chain, to form a pre-mixture before the other component (ii) or (i), as appropriate, is added to said pre-mixture.

The oily sugar derivative (ii) is preferably separately pre-mixed with at least one cationic surfactant having a single $C_8$–$C_{28}$ alkyl or alkenyl chain and optionally water, to form a pre-mixture before the cationic fabric softening compound (i) is added to said pre-mixture.

Preferably the cationic surfactant has a single $C_8$–$C_{20}$ alkyl or alkenyl chain, most preferably a single $C_{10}$–$C_{18}$ alkyl or alkenyl chain.

Suitable cationic surfactants include water soluble single chain quaternary ammonium compounds such as cetyl trimethyl ammonium chloride, cetyl trimethyl ammonium bromide, or any of those listed in European Patent No. 258 923 (Akzo). For example the cationic surfactant may be an alkyl tri-methylammonium methosulphate or chloride or alkyl ethoxyalkyl ammonium methosulphate or chloride. Examples include cetyl trimethyl ammonium chloride and coconut pentaethoxymethyl ammonium methosulphate and derivatives in which at least two of the methyl groups on the nitrogen atom are replaced by (poly)alkoxylated groups.

Preferably, the cation in the cationic surfactant is selected from alkyl tri-methylammonium methosulphates and their derivatives, in which at least two of the methyl groups on the nitrogen atom are replaced by (poly)alkoxylated groups.

Any suitable counter-ion may be used in the cationic surfactant. Preferred counter-ions for the cationic surfactants include halogens (especially chlorides), methosulphate, ethosulphate, tosylate, phosphate and nitrate.

Suitable commercially available cationic surfactants include the Ethoquad range from Akzo, e.g. Ethoquad 0/12 and Ethoquad HT/25.

The cationic surfactant is preferably present in an amount of 0.01–5% by weight, preferably 0.05%–3%, more preferably 0.1%–2%, based on the total weight of the composition.

Nonionic Surfactant

The cationic fabric softening compound (i) and/or the oily sugar derivative (ii) may separately be mixed with at least one nonionic surfactant and optionally water, preferably having a single $C_8$–$C_{28}$ alkyl or alkenyl chain, most preferably an alkoxylated nonionic surfactant having said chain, to form a pre-mixture before the other component (ii) or (i), as appropriate, is mixed with said pre-mixture.

Suitable nonionic surfactants include the condensation products of $C_8$–$C_{30}$ primary or secondary linear or branched alcohols preferably $C_{10}$–$C_{22}$ alcohols, alkoxylated with 10 or more moles of alkylene oxide, preferably 10–25 moles of alkylene oxide, more preferably between 10 and 20, more preferably 11 to 20 moles of alkylene oxide. Preferably the alkylene oxide is ethylene oxide although it may be/include propoxylate groups. The alcohols may be saturated or unsaturated, or branched.

Suitable alcohol ethoxylates include the condensation products of coconut fatty alcohol with 15–20 moles of ethylene oxide, e.g. coco 20 ethoxylate, and, condensation products of tallow alcohol with 10–20 moles of ethylene oxide, e.g. tallow 15 ethoxylate.

Other suitable examples include alkyl poly glucosides and other sugar based surfactants e.g. ethoxylated sorbitans.

The nonionic surfactants preferably have an HLB of from about 8 to 20, more preferably 10 to about 20, most preferably for example from 11 to 18, e.g. 13 to 17.

It is especially preferred that the oily sugar derivative (ii) is pre-mixed with water and/or with at least one nonionic surfactant having a single $C_8$–$C_{28}$ alkyl or alkenyl chain to form a pre-mixture and subsequently the softening compound (i) in at least partially liquid/molten state is mixed with pre-said mixture.

It is especially preferred that the cationic fabric softening compound (i) is pre-mixed at least one nonionic surfactant having a single $C_8$–$C_{28}$ alkyl or alkenyl chain surfactant, preferably an alkoxylated nonionic surfactant and optionally water, to form a pre-mixture and subsequently the oily sugar derivative is mixed with pre-said mixture.

Conventional types of anionic surfactants may also be included.

Typically the compositions will comprise one or more perfumes conventionally used in fabric softening compositions. The perfume can be an active ingredient according to the invention whereas the components in the immediate paragraph below are not.

Minor Ingredients

The composition may also contain one or more optional ingredients, selected from dyes, preservatives, antifoams electrolytes, non-aqueous solvents, pH buffering agents, perfume carriers, fluorescers, colorants, hydrotropes, anti-foaming agents, antiredeposition agents, enzymes, optical brightening agents, opacifiers, anti-shrinking agents, anti-wrinkle agents, anti-spotting agents, germicides, fungicides, anti-corrosion agents, drape imparting agents, antistatic agents, sunscreens, colour care agents and ironing aids.

It is especially preferred that if optional minor ingredients which are polyelectrolytes are present, such as dye and preservative, these are added after the oily sugar derivative and the cationic fabric softening agent have been brought into contact. If these components are added before this time then the compositions may not be stable and/or complexation of the oily sugar derivative with and the cationic fabric softening compound may result.

The compositions may comprise one or more antioxidants to reduce malodour of the compositions that may form upon storage, e.g. in an amount of 0.0001% to 1% by weight (in total). Preferably the antioxidant comprises at least one initiation inhibitor antioxidant or at least one propagation inhibitor. Mixtures of these two types of antioxidants have been found to be particularly beneficial, especially in reducing medium to long term malodour.

The compositions may also contain fatty acids, for example $C_8$–$C_{24}$ alkyl or alkenyl monocarboxylic acids, or, polymeric carboxylic acids. Preferably saturated fatty acids are used, in particular, hardened tallow $C_{16}$–$C_{18}$ fatty acids.

It may be advantageous if a viscosity control agent is present in the liquid compositions. Any viscosity control agent conventionally used with rinse conditioners is suitable. Synthetic polymers are useful viscosity control agents such as polyacrylic acid, poly vinyl pyrolidone, polyethylene, carbomers, cross linked polyacrylamides such as ACOSOL 880/882 polyethylene and polyethylene glycols.

Also suitable as viscosity modifiers are deflocculating polymers.

The viscosity control agents, e.g. polymers, may be incorporated to achieve a desirable viscosity for the final composition as desirable by the consumer. These agents may help to improve the creaming stability of the compositions.

Other polymers may also be included in the compositions. Suitable polymers include cationic and nonionic polymers. It is especially preferred that polymers, especially cationic polymers are included if the total amount of oily sugar derivative and cationic fabric softening agent is about or below 10 wt %. It is especially preferred that the polymers are added as part of the pre-mixtures with the oily sugar derivative and/or the cationic fabric softening agent.

Suitable cationic polymers include cationic guar polymers such as; the JAGUAR® series of polymers (ex Rhodia), cationic cellulose derivatives such as CELQUATS®, (ex National Starch), UCARE® polymers (ex Amerchol), cationic starches e.g. potato starch such as SOFTGELS®, eg BDA CS, and the SOLVITOSE® C* bond polymers series from Cerestar, and AMYLOFAX® (ex Avebe) and POLYGEL polymers K100 and K200 from Sigma, cationic polyacrylamides such as PCG (ex Allied Colloids), FLOCAID® series of polymers (ex National Starch) and cationic chitosan derivatives.

Suitable nonionic polymers include PLURONICS® (ex BASF), dialkyl PEGs, cellulose derivatives as described in GB 213 730 (Unilever), hydroxy ethyl cellulose, starch, and hydrophobically modified nonionic polyols such as ACUSOL® 880/882 (ex Rohm & Haas).

Mixtures of any of the aforementioned polymers may be used.

The polymer may be present in the compositions in an amount of 0.01–5% by weight based upon the total weight of the composition, more preferably 0.02–2.5%, such as 0.05–2%.

Product Form

The compositions produced by the method of the invention are in a gel or liquid form. Liquids, especially those having an emulsion component, are preferred.

Composition pH

The compositions of the invention preferably have a pH from 1.5 to 7, more preferably from 1.5 to 5.

Method of Treating Fabrics

The invention also provides a method of treating fabrics by applying thereto the composition produced by the methods described above. The compositions can by applied to the fabric by any suitable method. The preferred methods are by treatment of the fabric during a domestic laundering process such as by soaking, or, in the rinse cycle of a domestic washing machine.

EXAMPLES

The invention is further illustrated by the following non-limiting examples. Further examples within the scope of the present invention will be apparent to the person skilled in the art.

All percentages in the examples are by weight based on the total weight of the composition and refer to the amount of raw material added unless given otherwise. Examples according to the invention are denoted by numbers. The comparative examples are denoted by letters.

All the following examples were prepared on 200 ml batches using a three-stage pitch-blade impeller in a vessel with baffles. The mixing speed was ~800 rpm.

For all examples where the particle size was measured, this was calculated from the refractive index of the liquid which (according to (M S Mohammadi, Advances in Colloid and Interface Science 62 (1995) 17–29) provides a measure of the in-situ $d_{3,4}$-; the larger the refractive index for a given formulation the smaller the particles. The refractive indices of the stable emulsions are larger than those of the unstable ones (the base value of refractive index for comparison is that of pure water RI=1.33300).

The refractive index indicates the size of the droplets and relates to the number of droplets, that is it gives a measure of the average particle size. This in turn gives a measure of the stability which can be expected upon storage.

TABLE 1

Examples of Dilute and Concentrated compositions-initial physical properties

| Raw Materials | A | B | C | 1 | 2 |
|---|---|---|---|---|---|
| Cationic softener (1) | 2.17% | — | — | — | 2.17% |
| Cationic softener (2) | — | 2.65% | 2.12% | 2.12% | — |
| Oily sugar derivative (3) | 3.34% | 0.24% | 3.34% | 3.34% | 3.34% |
| Demineralised Water | to 100% | to 100% | to 100% | to 100% | to 100% |
| Composition Details | | | | | |
| Active Level/wt % (1) + (2) + (3) | 5% | 5% | 5% | 5% | 5% |
| Weight Ratio | 2.0 | 1.4 | 2.0 | 2.0 | 2.0 |

TABLE 1-continued

| Raw Materials | A | B | C | 1 | 2 |
|---|---|---|---|---|---|
| | Examples of Dilute and Concentrated compositions-initial physical properties | | | | |
| of Oil: cationic softener | | | | | |
| Process Temp./° C. (5) | 56 | 61 | 63 | 62 | 56 |
| Emulsification (4) | no | no | No | Yes | Yes |
| Instability; creaming | Instant | Instant | Instant | Stable | Stable |
| Refractive Index | 1.33525 | 1.33362 | 1.33556 | 1.33615 | 1.33608 |
| Complex formed between (1) or (2) and (3)? | yes | Yes | Yes | No | No |

(1) is di-hardened tallow-dimethyl ammonium chloride, approximately 77% active ingredient, 23% IPA (from Akzo Nobel).
(2) is 1, 2 bis [hardened tallowoyloxy]-3-trimethylammonium propane chloride, approximately 78.5% active ingredient (ammonium quaternary material + fatty acid at a 6:1 ratio)), 10% glycerol, 12% IPA (from Clariant)
(3) is sucrose polyaerucate (mainly tetra, penta and hexa erucate), available as Ryoto ER290 from Mitsubishi Ryoto Foods Corporation.
(4) indicates whether an emulsion was initially formed or whether lumps were present (complex structure).
(5) The processing temperature is explained in the methods or preparation.

The examples were prepared as follows;

Examples A and B: the oily sugar derivative and the cationic softener were heated together to form a liquid melt. The perfume was added thereto once the derivative and the softener had fully melted together. This melt was added to the water (which had been added to the vessel) over 5 minutes with agitation at 800 RPM. The process temperature given is that of the water. The temperature of the co-melt was approximately 60° C.

Example C: was prepared by a similar method to example A but the water was split into two parts. 50% of the total amount of water had already been added to the vessel and the co-melt of the derivative and softener was added to this water. The remaining 50% of the amount of water was added to the vessel slowly (at the processing temperature).

Examples 1 and 2: the oily sugar derivative and the perfume were mixed and charged into the vessel at 62° C. 50% of the total amount of water (at room temperature) was added over 5 minutes with agitation at 800 RPM. To the vessel, molten cationic softener was then added (at about 65° C.) after which the remaining 50% of the water was added.

By "creaming" as used in the table and elsewhere, it is meant the emulsion droplets separated from the water and rose to the top of the sample.

Where an example is marked "No" for emulsification it exhibited poor or non existent emulsification and large droplets were formed which quickly separated. Where an example is marked "Yes" for emulsification there was good emulsification giving small droplets with little or no lumps. This lack of emulsification does not simply mean the oil phase and surfactant phase are separate. Further information on the stability and properties are indicated by the "complex formed" row. If this is marked "yes", there was one phase but the resulting droplets showed no conventional emulsion structure and complex large particles (denoted by a cluster or aggregate) were formed—hence complex formation. The complex is not a chemical complex.

Comparative examples A, B and C show that by a conventional method of preparation involving the direct co-mixing/co-melting of the cationic fabric softener compound(s) with the oily sugar derivative, little emulsification takes place and phase separation ensues. However when the method of the present invention is followed, good emulsification occurs and a stable composition is formed.

TABLE 2

| Raw Materials | Example 3 | Example 4 |
|---|---|---|
| | Examples of fully-formulated dilute mixtures of cationic fabric softening compounds and oily sugar derivatives (initial physical properties). | |
| Cationic softener (2) | 3.06% | 2.55% |
| Oily sugar derivative (3) | 2.40% | 2.80% |
| Perfume | 0.32% | 0.32% |
| Preservative 20% solution) | 0.08% | 0.08% |
| Antifoam | 0.015% | 0.015% |
| dye (1% solution) | 0.10% | 0.10% |
| Demineralised water | To 100% | To 100% |
| Composition Details | | |
| Active level wt % (2) + (3) | 4.8% | 4.8% |
| Weight Ratio of Oil:cationic softener | 1.0 | 1.40 |
| Process Temp./° C. (5) | 62 | 62 |
| Emulsification (4) | Yes | Yes |
| Instability; creaming | Stable | stable |
| Refractive index | 1.33796 | 1.33900 |
| Complex formed between (2) and (3)? | No | no |

(2), (3), (4), (5) - see above

Examples 3 and 4: A blend of the oily sugar derivative and the perfume was added to the vessel. The cationic softener in a molten state was then added followed by the remaining water. Finally the minor components (dye, antifoam and preservative) were added.

Examples 3 and 4, and examples 3 and 4 demonstrate that when minor components such as preservative are included in the composition, it is desirable that they are post-dosed in order to obtain a good emulsion and a stable composition is obtained.

TABLE 3

| Raw Materials | Example D | Example E | Example 5 | Example 6 | Example 7 |
|---|---|---|---|---|---|
| Cationic softener (1) | 1.04% | — | — | — | — |
| Cationic softener (2) | — | 2.55% | 2.12% | 2.65% | 3.06% |
| Nonionic surfactant (6a) | 0.16% | — | — | — | — |
| Nonionic surfactant | — | 0.10% | 0.15% | 0.15% | 0.10% |

TABLE 3-continued

| Raw Materials | Example D | Example E | Example 5 | Example 6 | Example 7 |
|---|---|---|---|---|---|
| (6b) | | | | | |
| Oily sugar derivative (3) | 4.0% | 2.80% | 3.34% | 2.92% | 2.40% |
| Preservative (20% solution) | — | — | — | — | 0.08% |
| Antifoam | — | — | — | — | 0.015% |
| dye (1% solution) | — | — | — | — | 0.10% |
| Perfume | 0.32% | 0.32% | 0.24% | 0.24% | 0.32% |
| Demineralised Water | To 100 | To 100 | to 100% | to 100% | to 100% |
| Composition Details | | | | | |
| Active Level/wt % (1) + (2) + (3) | 4.8% | 4.8% | 5% | 5% | 4.8% |
| Weight Ratio of Oil: cationic softener | 5.0 | 1.4 | 2.0 | 1.4 | 1.0 |
| Process Temperature/ ° C. (5) | 60 | 62 | 63 | 63 | 62 |
| Emulsification (4) | Yes partial | Yes partial | Yes | Yes | Yes |
| Creaming | Slow | Slow | Stable | Stable | Stable |
| Refractive index | 1.33352 | — | 1.33665 | 1.33753 | 1.33893 |
| Complex formed between (1), (2), (3) and (6a/b) | Yes Reduced | Yes reduced | no | no | no |

(1), (2), (3), (4), (5) see above
(6a) is coconut 15 ethoxylate (Genapol 150 from Clariant).
(6b) is coconut 20 ethoxylate (Genapol 200 from Clariant).

Example D: The oily sugar derivative, cationic softener and nonionic surfactant were heated together until molten. The perfume was added to the melted mixture and this was charged into the vessel at the process temperature. The water was slowly added (at the process temperature) to the vessel.

Example E: A co-melt of the oily sugar derivative, the cationic softener, and nonionic surfactant was added to the water at 62° C. The temperature was reduced to about 35° C. and the perfume was added.

Examples 5 and 6: The oily sugar derivative and perfume were added to the 50% of the total amount of water. The cationic softener was added thereto as a melt with the nonionic surfactant. Finally the rest of the water was added.

Example 7 was prepared as above but the minor ingredients were added when the example was cooled to about 40° C.

The process of the invention produces the best results in terms of droplet size and stability (as indicated by the refractive indices). Although the presence of the nonionic surfactant reduces complex formation the method of the invention produces a product with better emulsion characteristics.

TABLE 4

Mixtures of cationic fabric softening compound and oily sugar derivative prepared with thickening polymer included (initial physical properties)

| Raw Materials | Example F | Example G | Example H | Example 8 |
|---|---|---|---|---|
| Cationic Softener (1) | 1.04% | 1.04% | — | — |
| Cationic softener (2) | — | — | — | 2.55% |
| Cationic softener (7) | — | — | 0.96% | — |
| Nonionic surfactant (6a) | — | 0.16% | 0.16% | 0.10% |
| Oily sugar derivative (3) | 4.0% | 4.0% | 4.0% | 2.8% |
| Perfume | 0.32% | 0.32% | 0.32% | 0.32% |
| Thickener polymer (8a) | 0.20% | 0.20% | 0.20% | — |
| Thickner polymer (8b) | — | — | — | 0.05% |
| Demineralised Water | to 100% | to 100% | To 100% | To 100% |
| Composition Details | | | | |
| Active Level/wt % (1) / (2) / (7) + (3) | 4.8% | 4.8% | 4.8% | 4.8% |
| Weight Ratio of Oil:cationic softener | 5.0 | 5.0 | 5.0 | 1.4 |
| Process (9) Temperature/ ° C. | 57/50 | 55/47/30 | 65/50/30 | 62/30 |
| Emulsification (4) | No | Yes | Yes | Yes |
| Creaming | Fast | stable | Stable | Stable |
| Refractive index | — | 1.33870 | 1.33533 | — |
| Complex formed between (1), (3) and (6) | Yes | Reduced | Reduced | No |

(1), (2), (3), (4), (6a) see above
(7) is the cationic softener DEEDMAC (~83% active including some fatty acid) and ~17% IPA (from Kao).
(8a) a cationically modified potato starch (SOFTGEL BDA ex Avebe -In its raw material form it is 100% active and in power form, it is prepared as a sloution to be added.
(8b) a hydrophobically modified hydroxyethyl cellulose called NATRASOL 331 (ex National Starch).
(9) The multiple temperatures indicate (i) polymer hydration temperature if polymer is added first (see later), (ii)

The Examples were prepared by the following methods;

Example F: The polymer powder was added to the batch water at 57° C. and mixed at 800 RPM for about 10 minutes until fully hydrated (indicated by a clear gel). The temperature of the batch was dropped to 50° C. by recirculating cold water through the vessel jacket. After this a melt of the oily sugar derivative, perfume and cationic softener was added.

Example G: The melt of oily sugar derivative, cationic softener and nonionic surfactant was added to the vessel at 55° C. 50% of the total amount of water was slowly added with agitation at 800 RPM. The composition was then cooled to 47° C. and perfume added (perfume was room temperature). The batch temperature was further reduced to 30° C. and the polymer solution added (from a 1% solution) to the vessel.

Example H: Prepared as for Example G but higher temperatures were used throughout due to the higher melting point of cationic softener.

Example 8: the oily sugar derivative was added to the water (at 62° C.) and stirred for about 10 minutes. Then a co-melt of the cationic softener and nonionic surfactant was added to the vessel. The batch was then cooled to about 30° C. for he addition of the perfume and afterwards the polymer solution (from a 1% solution in water) was added.

The comparison between these examples demonstrates that by using a thickener polymer the appearance can be improved by slowing down the rate of creaming. However, this approach does not completely prevent the formation of the clusters. This is only achieved if the method of the invention is followed.

The results demonstrate that the incorporation of a nonionic surfactant helps to create a more emulsion-like structure. However by first dosing the oily sugar derivative or a mixture thereof with perfume in water an emulsion structure can be obtained without the use of surfactants.

TABLE 5

| Raw materials | Example I | Example 9 | Example 10 | Example 11 |
|---|---|---|---|---|
| Cationic Softener (2) | 2.55% | 2.0% | 2.55% | 7.16% |
| Nonionic surfactant (6b) | 0.1% | 0.1% | 1.3% | 0.3% |
| Oily sugar derivative (3) | 2.8% | 2.8% | 2.8% | 7.875% |
| Cationic surfactant (10) | — | — | 0.25% | 0.70% |
| Perfume | 0.32% | 0.32% | 0.32% | 0.95% |
| Thickener polymer (8b) | 0.05% | 0.05% | 0.05% | — |
| Demineralised water | To 100% | To 100% | To 100% | To 100% |
| Composition details | | | | |
| Active Level wt % (2) + (3) | 4.8% | 4.8% | 4.8% | 13.5% |
| Weight Ratio of oil:cationic | 1.4 | 1.4 | 1.4 | 1.4 |
| Processing temp./° C. (5) | 52/35 | 62/35 | 25/62/35 | 25/62/35 |
| Emulsification (4) | partial | Yes | Yes | yes |
| Creaming Stability | No (slow) | Stable | Stable | Stable |
| Complex formed | Yes partial | No | No | no |

(2), (3), (4), (5), (6b), (8b) see above
(10) is cetyl trimethyl ammonium chloride, ex Aldrich Example I: a co-melt of cationic softener, nonionic surfactant and oily sugar derivative was added to the water (at temperature of 62° C.) and stirred. The vessel was then cooled to ~35° C., after which polymer and perfume, were added in that order. The resultant mixture was unstable, with complex particles clearly visible.

Example 9: the oily sugar derivative was added to the water (at 62° C.) and stirred. A co-melt of cationic softener and nonionic surfactant was then added with stirring. The vessel was then cooled to room temperature, after which the perfume was added followed by a 1% solution of the polymer.

Example 10: the cationic surfactant was added to the water at room temperature. The oily sugar derivative was then added to the vessel with mixing. The vessel was then heated to 62° C., and a co-melt of cationic softener and nonionic surfactant added to the vessel and stirred. The vessel was then cooled to room temperature, after which a 1% polymer solution was added followed by the addition of the perfume.

Example 11: was prepared by the method of example 10, but no polymer was added.

The results demonstrate that even with nonionic surfactant a conventional preparation method still results in complexation droplet formation and hence instability. However the degree to which the droplets have been formed is reduced. By using the method of the invention complexation is avoided.

Table 6; Separate Mixing Vessels

In examples 12 and 13, a dispersion of the cationic softener. was prepared in one vessel, and a dispersion of the oily sugar derivative prepared in another vessel, before the two dispersions were mixed.

| Raw materials | Example 12 | Example 13 |
|---|---|---|
| Vessel 1 | | |
| Cationic softener (2) | 5.09% | 5.09% |
| Nonionic surfactant (6b) | 0.20 | 0.2% |
| Demineralised water | To 100 | To 100% |
| Process temp./° C. (5) | 75 | 75 |
| Vessel 2 | | |
| Oily sugar derivative (3) | 5.6% | 20% |
| Cationic surfactant (10) | 0.5% | 2% |
| Demineralised water | To 100 | To 100% |
| Process temp./° C. (5) | Room temperature | Room temperature |
| Added afterwards | | |
| Perfume | 0.32 | 0.32% |
| Polymer (8b) | 0.05 | 0.05% |
| Details of final composition | | |
| active level wt % (2) + (3) | 4.8% | 4.8% |
| Weight ratio of oil:cationic | 1.4 | 1.4 |
| Stability | Stable | Stable |
| Complex formed | No | no |

(2), (3), (5), (6b), (8b), (10) - see above

The examples were made as follows:-

Example 12; In vessel 1, a co-melt of the cationic softener and the nonionic surfactant was added to the water (equilibrated at 75° C.). The vessel was then cooled to room temperature. In vessel 2, the cationic surfactant was added to the water (at room temperature), after which the oily sugar derivative was mixed in. The contents of vessel 2 were then added to the contents of vessel 1. Finally the polymer (1% solution) and perfume were stirred in.

Example 13; In vessel 1, a co-melt of the cationic softener and the nonionic surfactant was added to the water (equilibrated at 75° C.). The vessel was then cooled to room temperature. In vessel 2, the cationic surfactant was added to the water (room temperature), after which the oily sugar derivative was mixed in, to form a concentrated dispersion of the oily sugar derivative. The required amount of the concentrated dispersion from vessel 2 was added to vessel 1, so as to produce a final concentration of 2.0% softening cationic and 2.8% oily sugar derivative. Finally the polymer (1% solution) and perfume were stirred in.

The comparison between these and Example I shows again that the complex structure is removed and stability gained.

Table 7: Comparison of the softness results obtained by using compositions produced according to the invention and by those produced by conventional methods.

Examples made according to the invention were tested against a control; a commercial composition containing cationic softener (2) above. Different anionic carryover concentrations (of a 1% ABS solution) were used as detailed below.

| Example | No carryover | 1.5 ml carryover | 3 ml carryover |
|---|---|---|---|
| Example G | 4.50 | 4.16 | 5.0 |
| Example 1 | 5.00 | 3.40 | 4.50 |
| Example 2 | 4.74 | 3.50 | 4.40 |
| Control | 4.00 | 2.50 | 3.40 |

The softening performance of the examples was evaluated by adding amount of prototype to deliver the equivalent of 2 ml of a 5 wt % dispersion, i.e. 0.1 g active per 40 g of cloth) to 1 litre of tap water, at ambient temperature in a tergotometer. 1 ml of a 1 wt % alkyl benzene sulphonate solution, per 1 litre of tergotometer pot water, was added to simulate anionic surfactant carried over from the main wash.

Three pieces of terry towelling (8 cm×8 cm, 40 g total weight) were added to the tergotometer pot. The cloths were treated for 5 minutes at 65 rpm, spin dried to remove excess liquor and line dried overnight and conditioned at 21° C. and 65% relative humidity for 24 hours.

Softening of the fabrics was assessed by an expert panel of 4 people using a round robin paired comparison test protocol. Each panel member assessed four sets of test cloths. Each set of test cloths contained one cloth of each test system under evaluation. Panel members were asked to assess softness on an 8 point scale. Softness scores were calculated using an "Analysis of Variance" technique. Lower values indicate better softening as assessed by the panelists.

Examples 14 to 16: Fully Formulated Compositions

Fully formulated compositions produced according to the method of the invention are given in the following table.

| Components | Example 14 | Example 15 | Example 16 |
|---|---|---|---|
| Cationic softener (2) | 3.375 | — | — |
| Cationic softener (11) | — | 9.75 | 12.50 |
| Nonionic surfactant (6b) | 0.10 | 0.75 | 1.50 |
| Oily sugar derivative (3) | 1.125 | 3.25 | 1.00 |
| Thickening polymer (8b) | 0.005 | — | — |
| Perfume | 0.32 | 0.96 | 0.96 |
| Preservative solution 20% | 0.016 | 0.008 | — |
| Antifoam (12) | 0.03 | 0.015 | — |
| Water | To 100% | To 100% | To 100% |

(2), (3), (6b), (8b) - see above
(11) N,N-di (hardened tallowoyloxyethyl)-N-hydroxyethyl-N-methyl ammonium sulphate, available as tetranyl AHT1 (85% active, ex Kao).
(12) silbione Examples 14–16 were prepared as follows:

The water was heated to 75° C. and (examples 14 and 15 only) the preservative and anti-foam were added. The oily sugar derivative and nonionic surfactant were blended and heated to 40° C. and added to the mixture. The cationic surfactant was then slowly added over 3–5 minutes and mixed thoroughly. The mixture was cooled to 50° C. and perfume and (example 14 only) thickening polymer were added. The mixture was then allowed to cool.

TABLE 8

Comparison of the Perfume intensity and longevity results obtained by using compositions produced according to the invention and by those produced by conventional methods.

| | Wet | 5 hours dry | 24 hours dry | 48 hours dry |
|---|---|---|---|---|
| Example G | 3.39 | 2.27 | 1.68 | 1.19 |
| Example 1 | 3.25 | 2.27 | 1.26 | 0.60 |
| Example 2 | 3.07 | 2.24 | 1.24 | 0.79 |
| control | 2.88 | 1.53 | 0.95 | 0.56 |

The control was a commercially available concentrated fabric softener (containing 13.5 wt % 1,2-bis[hardened tallowoyloxy]-3-trimethylammonium propane chloride.

De-sized terry towelling cloths are treated with a standard dose (0.25% weight of active on fabric) of the prototype formulations in a tergotometer. This is done by first putting one litre of Wirral tap water into the tergo-pot. To simulate the effect of anionic carryover form the main wash, 1 ml of a 1% linear alkyl benzene sulphonate solution is also added to the water. The three cloths (20 cm by 20 cm) are first soaked in the water for a minute before being removed and any excess water wrung out. Next the prototype rinse conditioner is added to the water and fully dispersed prior to the replacement of the cloths in the water. The cloths are agitated in the water for 5 minutes before being removed, spun out and left to line dry.

The cloths (three for each treatment) are then assessed for perfume intensity by a trained panel at various stages of the drying cycle; 5, 24 and 48 hours after rinsing. The intensity of the perfume at each stage is scaled on a 0 to 5 basis with 0 being no perfume detectable and 5 being very strong.

What is claimed is:

1. A method for the preparation of an aqueous fabric softening composition comprising:

(i) 0.5% wt to 30% wt of at least one cationic fabric softening compound having two or more alkyl or alkenyl chains each having an average chain length equal to, or greater than, $C_8$; and (ii) 0.5 % wt to 50 % wt of at least one oily sugar derivative; wherein the oily sugar derivative is a liquid or soft solid derivative of a cyclic polyol or of a reduced saccharide, said derivative resulting from 35 to 100% of the hydroxyl groups in said polyol or in said saccharide being esterified or etherified, and wherein the oily sugar derivative has two or more ester or ether groups independently attached to a $C_8$–C22 alkyl or alkenyl chain;

wherein the cationic fabric softening compound (i) is separately mixed with a nonionic surfactant to form a pre-mixture prior to the admixing of the cationic softening compound (i) with the oily sugar derivative, or wherein the oily sugar derivative (ii) is separately mixed with a perfume to form a pre-mixture prior to the admixing of the softening compound (i) with the oily sugar derivative (ii).

2. A method according to claim 1, wherein the oily sugar derivative (ii) is pre-mixed with at least one cationic having a single $C_8$–$C_{28}$ alkyl or alkenyl chain and/or nonionic surfactant and optionally water to form a pre-mixture and subsequently the softening compound (i), in at least partially liquid or molten state, is mixed with said pre-mixture.

3. A method according to claim 2, wherein the pre-mixture formed from the oily sugar derivative (ii) is at a temperature of at least 30° C. when the softening compound (i) is mixed therewith, or it is heated to said temperature thereafter.

4. A method according to claim 1, wherein the softening compound (i) is pre-mixed with at least one cationic and/or nonionic surfactant having a single $C_8$–$C_{28}$ alkyl or alkenyl chain to form a pre-mixture and subsequently the oily sugar derivative (ii) is mixed with said pre-mixture.

5. A method according to claim 1, wherein softening compound (i) is a quaternary ammonium compound having two or more $C_{12-28}$ alkyl or alkenyl chains.

6. A method according to claim 1, wherein the oily sugar derivative is a liquid or soft solid derivative of a cyclic polyol or of a reduced saccharide resulting from 40–80% of the hydroxyl groups in said polyol or in said saccharide being esterified or etherified.

7. A method according to claim 1, wherein the weight ratio of the softening compound: oily sugar derivative is in the range 99:1 to 1:10.

8. A method for the preparation of an aqueous fabric softening composition comprising:

(i) 0.5% wt to 30% wt of at least one cationic fabric softening compound having two or more alkyl or alkenyl chains each having an average chain length equal to, or greater than, $C_8$; and (ii) 0.5% wt to 50% wt of at least one oily sugar derivative;

wherein the oily sugar derivative is a liquid or soft solid derivative of a cyclic polyol or of a reduced saccharide, said derivative resulting from 35 to 100% of the hydroxyl groups in said polyol or in said saccharide being esterified or etherified, and wherein the oily sugar derivative has two or more ester or ether groups independently attached to a $C_8$–$C_{22}$ alkyl or alkenyl chain;

wherein an aqueous dispersion of said cationic fabric softening compound (i) is prepared in one vessel and an aqueous dispersion of said oily sugar derivative (ii) is prepared in another vessel prior to mixing said two dispersions.

* * * * *